United States Patent [19]

Buss

[11] 3,953,041

[45] Apr. 27, 1976

[54] LARGE WHEEL ROLLER SKATE

[75] Inventor: Herman Buss, Carrollton, Tex.

[73] Assignee: Lawrence Peska Associates, Inc., New York, N.Y. ; a part interest

[22] Filed: Feb. 6, 1975

[21] Appl. No.: 547,719

[52] U.S. Cl. ..... 280/11.26; 280/11.27

[51] Int. Cl.[2] ..... A63C 17/02; A63C 1/26

[58] Field of Search ..... 280/11.26, 11.19, 11.27, 280/11.3, 11.28, 11.1 R

[56] References Cited

UNITED STATES PATENTS

| | | | |
|---|---|---|---|
| 329,532 | 11/1885 | Burton | 280/11.28 |
| 1,608,368 | 11/1926 | Bugg | 280/11.19 |
| 2,021,035 | 11/1935 | Vogt | 280/11.26 |
| 2,067,712 | 1/1937 | Knapp | 280/11.26 |
| 3,007,706 | 11/1961 | Pullen | 280/11.26 |
| 3,545,779 | 12/1970 | Simms | 280/11.28 |
| 3,693,988 | 9/1972 | Steinhiser | 280/11.26 |
| 3,781,027 | 12/1973 | Taylor | 280/11.26 |

FOREIGN PATENTS OR APPLICATIONS

| | | | |
|---|---|---|---|
| 901,982 | 11/1944 | France | 280/11.19 |

*Primary Examiner*—M. H. Wood, Jr.
*Assistant Examiner*—Milton L. Smith
*Attorney, Agent, or Firm*—Richard E. Nanfeldt

[57] ABSTRACT

A thermoplastic roller skate of adjustable length has a toe supporting section, a heel supporting section, and an extensible shank portion. The toe section consists of a toe platform and a rearwardly extending rectangular bar shaped first shank member integrally joined to the toe platform. The heel section consists of a heel platform and a second shank member having a rectangular bar shaped channel, wherein the second shank member is integrally joined to a forward portion of the heel platform. The first shank member is slidably contained in the channel of the second shank member. A mechanism is provided for locking in position the first shank member within the channel of the second shank member. An axle assembly is affixed to the underside of the heel and toe platform. A five inch plastic wheel is affixed to each end of the two axle rods.

3 Claims, 4 Drawing Figures

LARGE WHEEL ROLLER SKATE

SUMMARY OF THE INVENTION

My invention relates to a unique and novel thermoplastic roller skate having enlarged wheels and an extensible shank portion.

U.S. Pat. Nos. 3,693,988 and 3,781,027 relate to roller skates, but these aforementioned patents are non-applicable to my present invention.

An object of my present invention is to provide a thermoplastic roller skate having an extensible shank portion.

A further object of my present invention is to provide a positive locking means for the extensible shank portion of the skate.

A still further object of my present invention is to provide a roller skate of low cost and simple design.

Briefly, my present invention comprises a thermoplastic roller skate of an adjustable length having a toe supporting section, a heel supporting section, and an extensible shank portion. The toe section consists of a toe platform and a rearwardly extending rectangular bar shaped first shank member integrally joined to the toe platform. The heel section consists of a heel platform and a second shank member having a rectangular bar shaped channel, wherein the second shank member is integrally joined to a forward portion of the heel platform. The first shank member is slidably contained in the channel of the second shank member. A mechanism is provided for locking in position the first shank member within the channel of the second shank member. An axle assembly is affixed to the underside of the heel and toe platform. A five inch plastic wheel is affixed to each end of the two axle rods.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
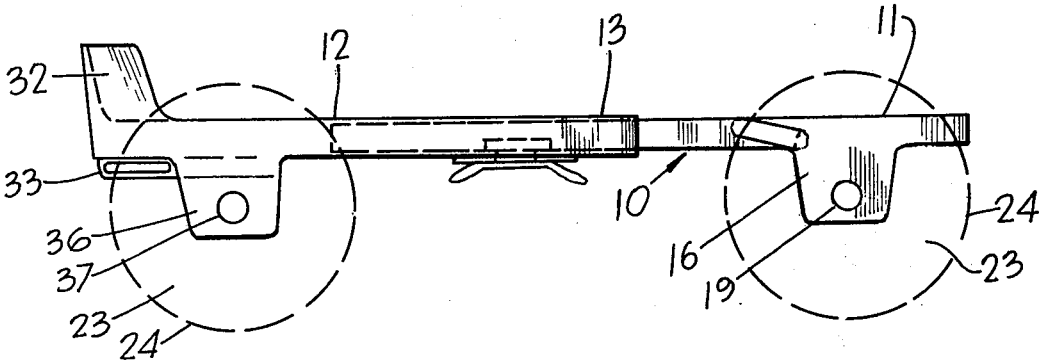
FIG. 1 illustrates a side cross sectional view of a roller skate.
Figure 2:
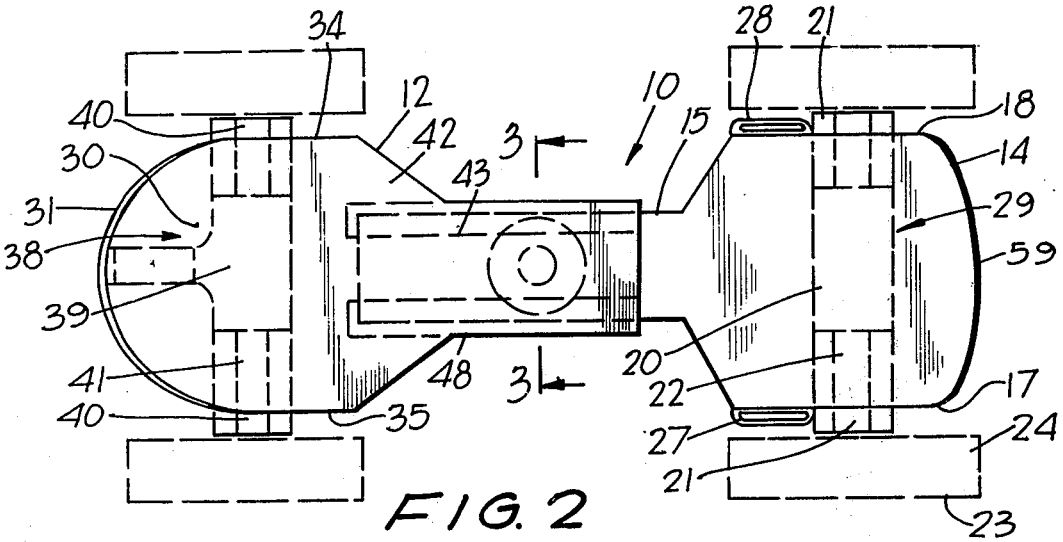
FIG. 2 illustrates a top cross sectional view of the roller skate.

Turning now descriptively to the drawings, in which similar reference characters denote similar elements throughout the several views, FIGS. 1–2 show a large wheel roller skate 10 broadly consisting of a toe supporting section 11, a heel supporting section 12 and an extensible shank portion 13. The toe section 11 consists of a generally rectangularly shaped forward toe platform 14 having a planar top surface and a forward curved edge 59. A first shank member 15 of a rectangular bar shaped configuration is integrally joined to the rearward edge of the platform 14. A pair of first downwardly extending bracket elements 16 is joined to the sides 17, 18 of the platform 14, wherein each bracket 16 has a first hole 19 therethrough. A first axle assembly 29 consists of a first ball bearing mounting assembly 20 secured to the underside of platform 14, wherein the ends 21 of a first axle rod 22 are rotatably contained in assembly 20 and extend outward through the first holes 19 of the brackets 16.

Figure 4:
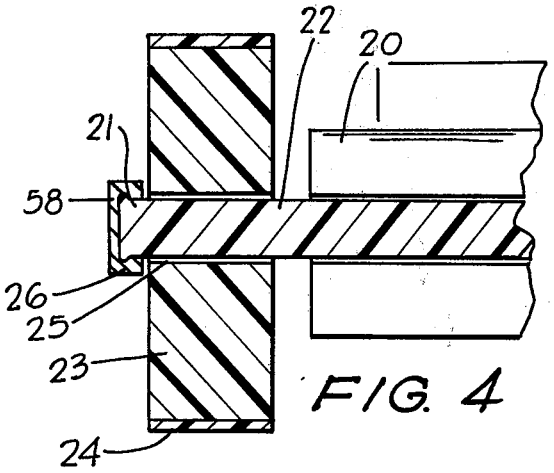
FIG. 4 illustrates a fragmentary end view of a wheel and axle assembly of the roller skate.

As shown in FIG. 4, a five inch plastic wheel 23 has a rubberized circumference 24 and a central axial hole 25 therethrough. A bearing fitting 26 is embedded into each axial hole, wherein the ends 21 of the axle rod 22 each pass through a bearing fitting 26. Referring back to FIGS. 1, 2, strap bracket members 27, 28 are affixed to each side 17, 18 of the platform 14 rearwardly of each bracket 16. The heel supporting section 12 comprises a planar rear heel platform 30 having a curved rear edge 31, wherein a curved heel guard portion 32 extends upwardly from the curved rear edge 31. Second strap brackets 33 extend downward from a rear portion of the straight side edges 34, 35 of the heel platform 30. Second downwardly extending brackets 36 having a second hole 37 therethrough are affixed to side edges 34, 35 forward of strap brackets 33. A second axle assembly 38 consists of a second ball bearing mounting assembly 39 secured to the underside of platform 30, wherein the ends 40 of a second axle rod 41 are rotatably contained in the assembly and extend outward through the second holes 37 of brackets 36. The plastic wheels 23 having bearing fittings 26 are secured onto the ends 40 of the second axle rod 41. The forward portion 42 of the heel platform 30 is tapered into an elongated rectangular shaped plate 43.

Figure 3:
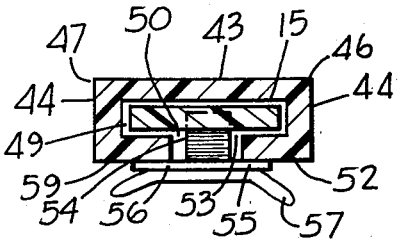
FIG. 3 illustrates a detailed fragmentary cross sectional view of FIG. 2 taken along line 3—3 of an extensible shank portion of the roller skate.

A pair of L shaped flange members 44, as shown in FIGS. 2, 3 extend downward from the sides 46, 47 of the plate 43 forming a second shank portion 48 having a rectangular shaped channel 49, wherein a gap 50 extends between the flat horizontal portions 59, 52 of each flange member 44, 45. Each flange member 44, extends rearwardly under the heel platform permitting the first shank member 15 to be slidably contained within the channel 49 of the second shank protion 48. The center of the bottom base 53 of the first shank member 15 has a threaded aperture 54 therein. A horizontally placed clamp plate 55 having a central opening 56 therethrough engages the bottom surfaces of portions 51, 52. A wing screw 57 extends upward through opening 56 to threadably engage the threaded aperture 54. As the wing screw is tightened, the first shank member 15 is pulled downward within channel 49 to frictionally engage the upper surfaces of the horizontal portions 51, 52, wherein the first shank member 15 is locked in position within the second shank-member 48.

FIG. 4 shows a clamp member 58 engaging one end 21 of the first axle rod 22 and abutting the plastic wheel 23, wherein the wheel 23 is prevented from sliding off the end 21 of the axle rod 22. An identical clamping means is used for the ends 40 of the second axle rod 41.

The component parts of the roller skate are formed from high impact thermoplastics such as high density polyethylene, ABS, high impact polystyrene, and high impact polypropylene.

Hence, obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A roller skate, which comprises:

a. a toe supporting section having a rectangularly shaped forward toe platform joined integrally to a forward first shank member of a rectangular bar shaped configuration, a bottom base of said first shank member having a threaded aperture therein;

b. a first axle assembly communicating with an underside of said forward toe platform;

c. a heel supporting section formed from a planar rear heel platform having a curved rear edge and a second shank member extending forwardly from said heel supporting section, said second shank member including an elongated rectangularly shaped plate, a pair of L-shaped flange members extending downwardly from each side of said plate, wherein the horizontal portions of said L-shaped flange members extend inwardly towards each other forming a gap between said horizontal portions, said plate and said L-shaped flange members defining a rectangularly shaped channel therein, and said first shank member being slidably contained within said rectangularly shaped channel;

d. a horizontally placed clamp plate having a central opening therethrough, said clamp plate engaging a bottom surface of said horizontal portions of said second shank member;

e. a wing screw extending upwardly through said central opening of said clamp plate to threadably engage said threaded aperture in said first shank member said first shank member and said clamp member frictionally engaging said horizontal portions of said second shank member as said wing screw threadably engages into said threaded aperture of said first shank member;

f. a heel guard portion extending upwardly from said curved rear edge of said heel supporting section;

g. a second axle assembly communicating with an underside of said planar rear heel platform;

h. a pair of large plastic wheels communicating with each said first and second axle assemblies, said axles extending through said wheels;

i. a pair of first strap bracket members joined to said toe platform;

j. a pair of second strap bracket members joined to said heel platform, said second strap members extending downwardly from a rear portion of straight side edges of said heel platform;

k. strap members extending through said first and second strap bracket members; and l. a clamp member affixed onto an end of each said axle, each said clamp member being positioned outside of each said wheel.

2. A roller skate as recited in claim 1, wherein said first axle assembly further comprises:

a. a pair of first downwardly extending bracket elements joined to the sides of said toe platform, wherein each said first bracket element has a first hole therethrough;

b. a first ball bearing mounting assembly secured to said underside of said toe platform;

c. a first axle rod rotatably contained in said first ball bearing mounting assembly; and d. each end of said first axle rod extending through said first holes, wherein said wheels communicate with said ends of said first axle rod.

3. A roller skate as recited in claim 2, wherein said second axle assembly further comprises:

a. a pair of second downwardly extending bracket elements joined to the sides of said heel platform, wherein each said second bracket elements has a second hole therethrough;

b. a second ball bearing mounting assembly secured to said underside of said heel platform;

c. a second axle rod rotatably contained in said second ball bearing mounting assembly; and d. each end of said second axle rod extending through said second holes, wherein said wheels communicate with said ends of said first axle rod.

* * * * *